US005899297A

United States Patent [19]

Clark

[11] Patent Number: 5,899,297

[45] Date of Patent: May 4, 1999

[54] ADJUSTABLE WORKMAN'S BED SYSTEM

[76] Inventor: Christopher M. Clark, 1401 Armstrong Valley Rd., Halifax, Pa. 17032

[21] Appl. No.: 09/118,076

[22] Filed: Jul. 16, 1998

[51] Int. Cl.[6] ..... E06C 7/16

[52] U.S. Cl. ..... 182/230; 182/222; 5/607; 280/32.5; 280/79.11

[58] Field of Search ..... 182/115, 116, 182/222, 230; 280/32.5, 79.11, 87.01, 79.4, 79.6; 5/81 R, 607

[56] References Cited

U.S. PATENT DOCUMENTS

| | | | |
|---|---|---|---|
| 788,883 | 5/1905 | Brown | 182/115 |
| 1,644,043 | 10/1927 | Tiedemann | 5/607 |
| 3,081,085 | 3/1963 | De Girolamo | 5/607 X |
| 3,873,118 | 3/1975 | Takagi | 280/79.11 X |

*Primary Examiner*—Daniel P. Stodola
*Assistant Examiner*—Hugh B. Thompson

[57] ABSTRACT

An adjustable workman's bed system including a bed formed of a rigid material in a generally planar configuration having an upper surface and a lower surface and having parallel side edges with an upper edge and a lower edge, the upper edge having a recess in a generally rectilinear configuration extending downwardly from the upper edge and a foot rest extending upwardly from the lower edge, a central support plate with an arcuate recess parallel with the upper and lower edges formed on the lower surface with an upper support plate with a cylindrical recess formed therein on the lower surface of the bed, a base formed of a rigid material with a base plate having an upper surface and a lower surface, a post extending upwardly from a central extent at the upper surface of the base plate with a tube horizontally positioned thereon for pivotally receiving an arcuate recess of the upper support plate, the post having a cylindrical recess therein facing towards the upper edge of the bed, and at least one pin having an upper end positionable within the cylindrical recess of the upper support plate and a lower end positionable within the cylindrical recess of the post.

8 Claims, 3 Drawing Sheets

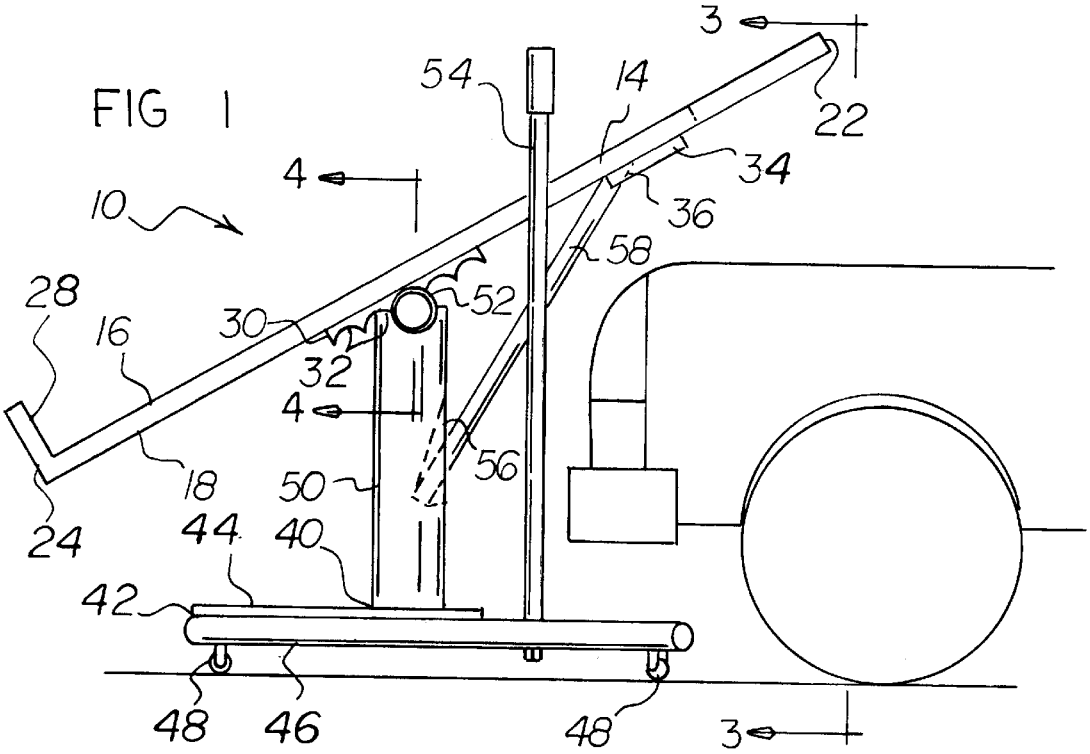
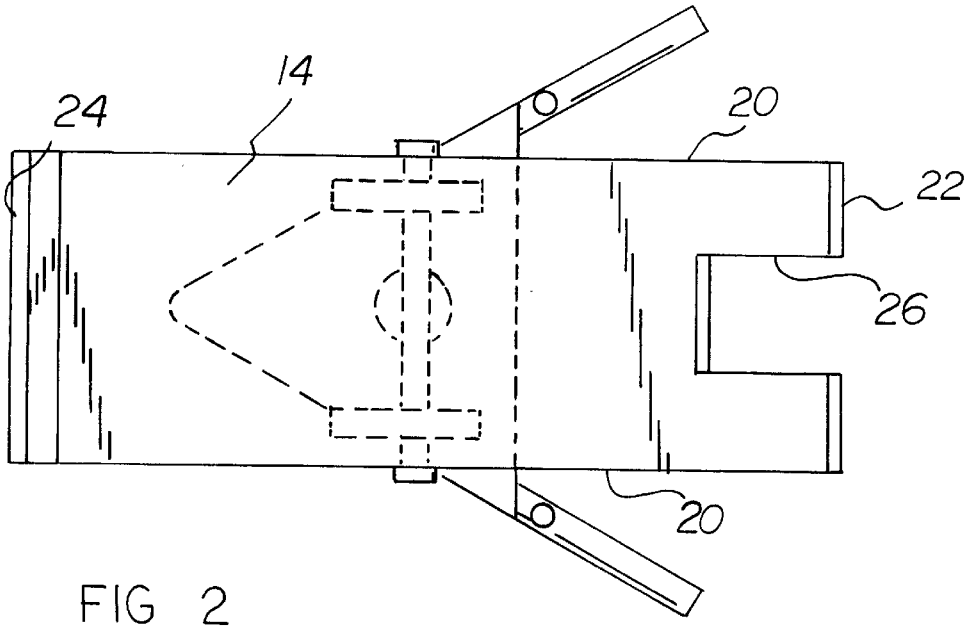
FIG 2

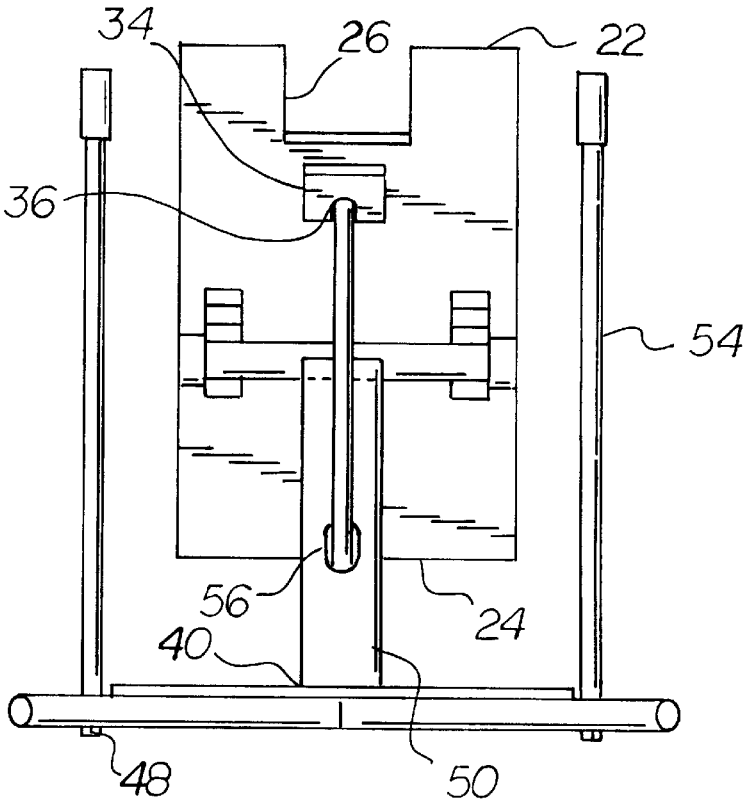
FIG 3
FIG 4
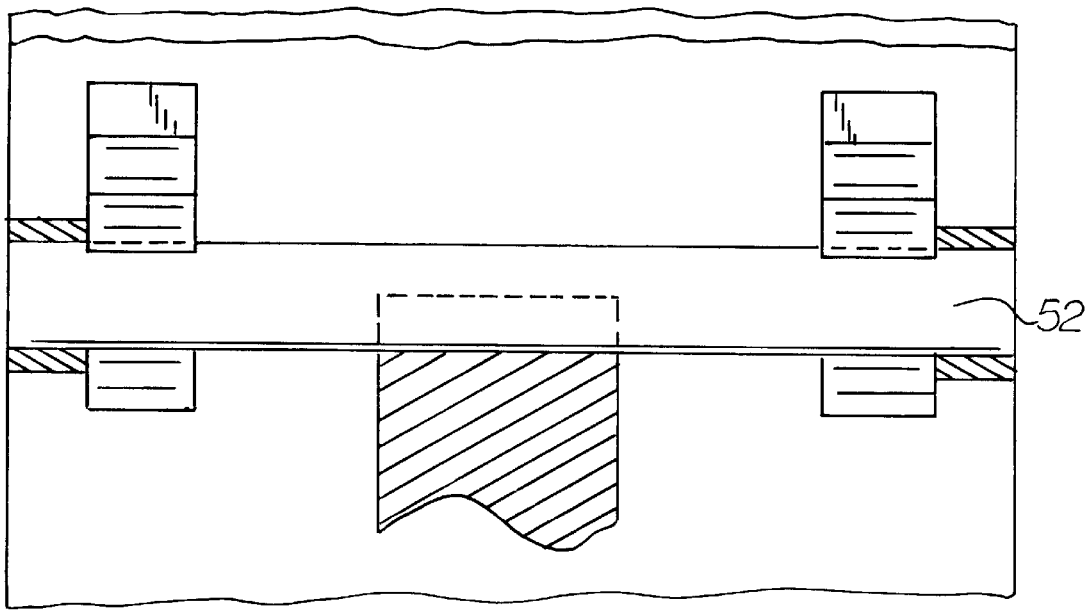

ADJUSTABLE WORKMAN'S BED SYSTEM

BACKGROUND OF THE INVENTION

1. Field of the Invention

The present invention relates to an adjustable workman's bed system and more particularly pertains to providing a support surface for a workman selectively positioned to facilitate his convenient positioning.

2. Description of the Prior Art

The use of support surfaces of various designs and configurations is known in the prior art. More specifically, support surfaces of various designs and configurations heretofore devised and utilized for the purpose of varying the support of a worker through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,397,374 to Rumage et al. discloses an Auto Mechanic's Body Support. U.S. Pat. No. 4,964,487 to Webb et al. discloses a Device for Supporting a Mechanic in a Horizontal Position Above an Automotive Vehicle Engine Compartment. U.S. Pat. No. 2,701,163 to Schemers discloses an Elevated Platform Dolly. U.S. Pat. No. 4,546,967 discloses an Exercise Bench. International Application Number PCT/AU88/00254 to Van Son discloses a Worker Support. European Patent Application Number 88201662.9 to Lock discloses an Adjustable Support Table for Medical Use. Lastly, U.S. Pat. No. 3,120,954 to Apostol discloses a Muscle Exercising Apparatus.

In this respect, the adjustable workman's bed system according to the present invention substantially departs from the conventional concepts and designs of the prior art, and in doing so provides an apparatus primarily developed for the purpose of providing a support surface for a workman selectively positioned to facilitate his convenient positioning.

Therefore, it can be appreciated that there exists a continuing need for a new and improved adjustable workman's bed system which can be used for providing a support surface for a workman selectively positioned to facilitate his convenient positioning. In this regard, the present invention substantially fulfills this need.

SUMMARY OF THE INVENTION

In view of the foregoing disadvantages inherent in the known types of support surfaces of various designs and configurations now present in the prior art, the present invention provides an improved adjustable workman's bed system. As such, the general purpose of the present invention, which will be described subsequently in greater detail, is to provide a new and improved an adjustable workman's bed system and method which has all the advantages of the prior art and none of the disadvantages.

To attain this, the present invention is a new and improved adjustable workman's bed system for providing a support surface for a workman selectively positioned to facilitate his convenient positioning comprising essentially of a bed formed of a rigid material in a generally planar configuration having an upper surface and a lower surface and having parallel side edges with an upper edge and a lower edge. The upper edge has a recess in a generally rectilinear configuration extending downwardly from the upper edge and a foot rest extending upwardly from the lower edge, a central support plate with a plurality of recesses parallel with the upper and lower edges formed on the lower surface with an upper support plate with a cylindrical recess formed therein on the lower surface of the bed. Also provided is a base formed of a rigid material with a base plate having an upper surface and a lower surface, the base plate being formed with four castors extending downwardly from the corners of the lower surface of the base plate, a post extending upwardly from a central extent at the upper surface of the base plate with a tube horizontally positioned thereon for pivotally receiving an arcuate recess of the upper support plate, the base plate also having a pair of hand poles extending upwardly from the upper surface of the base plate adjacent to the upper edge of the bed and to a height thereabove, the post having a cylindrical recess therein facing towards the upper edge of the bed. Lastly provided is a plurality of pins of varying lengths, each pin having an upper end positionable within the cylindrical recess of the upper support plate and a lower end positionable within the cylindrical recess of the post to vary the working angle of the bed and the worker supported thereon.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable workman's bed system which has all of the advantages of the prior art support surfaces of various designs and configurations and none of the disadvantages.

It is another object of the present invention to provide a new and improved adjustable workman's bed system which may be easily and efficiently manufactured and marketed.

It is further object of the present invention to provide a new and improved adjustable workman's bed system which is of durable and reliable constructions.

An even further object of the present invention is to provide a new and improved adjustable workman's bed system which is susceptible of a low cost of manufacture with regard to both materials and labor, and which accordingly is then susceptible of low prices of sale to the consuming public, thereby making such an adjustable workman's bed system economically available to the buying public.

Even still another object of the present invention is to provide an adjustable workman's bed system for providing a support surface for a workman selectively positioned to facilitate his convenient positioning.

Lastly, it is an object of the present invention to provide a new and improved adjustable workman's bed system including a bed formed of a rigid material in a generally planar configuration having an upper surface and a lower surface and having parallel side edges with an upper edge and a lower edge, the upper edge having a recess in a generally rectilinear configuration extending downwardly from the upper edge and a foot rest extending upwardly from the lower edge, a central support plate with an arcuate recess parallel with the upper and lower edges formed on the lower surface with an upper support plate with a cylindrical recess formed therein on the lower surface of the bed, a base formed of a rigid material with a base plate having an upper surface and a lower surface, a post extending upwardly from a central extent at the upper surface of the base plate with a tube horizontally positioned thereon for pivotally receiving an arcuate recess of the upper support plate, the post having a cylindrical recess therein facing towards the upper edge of the bed, and at least one pin having an upper end positionable within the cylindrical recess of the upper support plate and a lower end positionable within the cylindrical recess of the post.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the preferred embodiment of the adjustable workman's bed system constructed in accordance with the principles of the present invention.

FIG. 2 is a top elevational view of the system shown in FIG. 1.

FIG. 3 is a front elevational view taken along line 3—3 of FIG. 1.

FIG. 4 is a cross-sectional view taken along line 4—4 of FIG. 1.

The same reference numerals refer to the same parts through the various Figures.

DESCRIPTION OF THE PREFERRED EMBODIMENT

Figure 5:
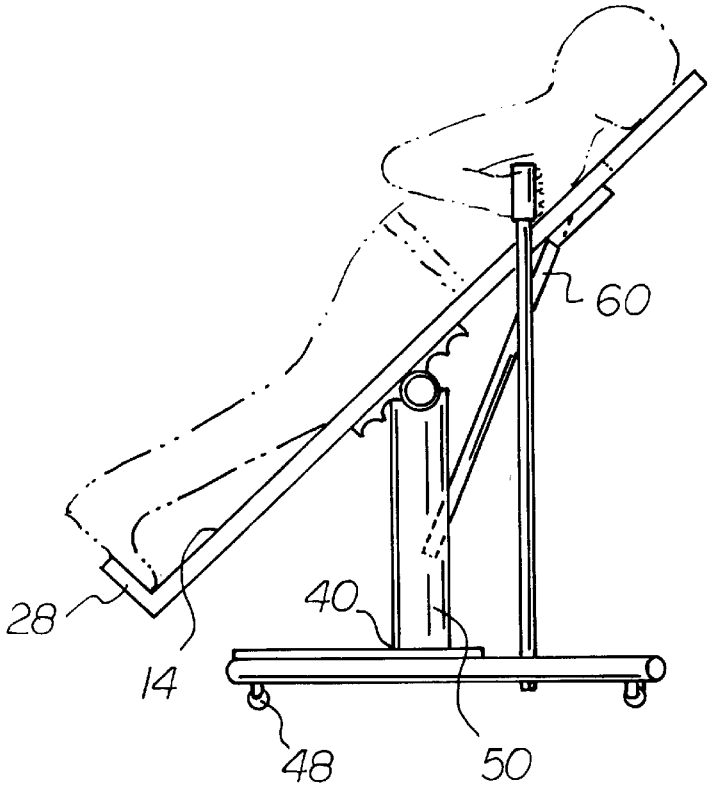
FIG. 5 is a side elevational view of the system of the prior Figures illustrating a worker in a working position and with the bed at a different angle.
Figure 6:
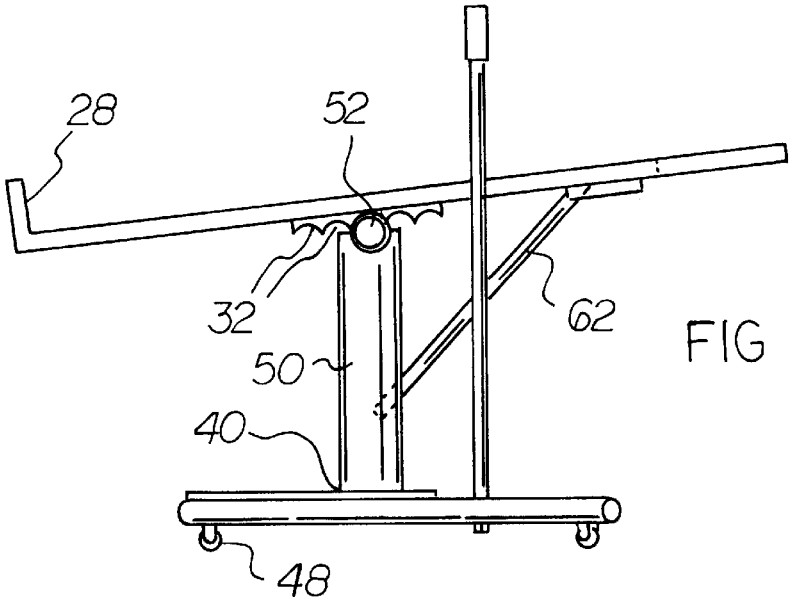
FIG. 6 is a view similar to FIG. 5 but without the worker and showing the bed at yet a further angle.

With reference now to the drawings, and in particular to FIG. 1 thereof, the preferred embodiment of the new and improved an adjustable workman's bed system embodying the principles and concepts of the present invention and generally designated by the reference numeral 10 will be described.

The present invention, the an adjustable workman's bed system 10 is comprised of a plurality of components. Such components are individually configured and correlated with respect to each other so as to attain the desired objective.

More specifically, the present invention consists of a bed 14 formed of a rigid material in a generally planar configuration having an upper surface 16 and a lower surface 18 and having parallel side edges 20 with an upper edge 22 and a lower edge 24. The upper edge 22 has a recess 26 in a generally rectilinear configuration extending downwardly from the upper edge and a foot rest 28 extending upwardly from the lower edge 24. A central support plate 30 is provided with a plurality of recesses 32 parallel with the upper and lower edges formed on the lower surface with an upper support plate 34 with a cylindrical recess 36 formed therein on the lower surface of the bed.

A base 40 formed of a rigid material is provided with a base plate 42 having an upper surface 44 and a lower surface 46, the base plate being formed with four castors 48 extending downwardly from the corners of the lower surface of the base plate, a post 50 extending upwardly from a central extent at the upper surface of the base plate with a tube 52 horizontally positioned thereon for pivotally receiving an arcuate recess of the upper support plate. The base plate 40 also has a pair of hand poles 54 extending upwardly from the upper surface of the base plate adjacent to the upper edge of the bed and to a height thereabove. The post also has a cylindrical recess 56 therein facing towards the upper edge of the bed.

Lastly provided is a plurality of pins 58, 60 and 62 of varying lengths. Each pin has an upper end positionable within the cylindrical recess 36 of the upper support plate and a lower end positionable within the cylindrical recess 56 of the post to vary the working angle of the bed and the worker supported thereon.

As described hereinabove, the present invention is a device that is a movable, inclined platform, which is used by automotive technicians during repair work. Technicians could lie in an inclined or almost level position on the platform, depending on the type of repair or type of vehicle on which they were working.

The invention consists of two main parts, the base or support assembly and the working surface. Two tubular steel beams, with a steel plate welded or bolted to the tops of the beams, comprise the main part of this structure. In addition, four heavy duty casters or wheels are provided to move the assembly and lock it in place as desired. A riser section is provided in the central area of this assembly to support the working surface. Overall width and length of this part of the invention would be approximately 2½ feet and 7 feet, respectively.

The working surface, larger than the supporting base can vary in width and length depending on the type of vehicle being serviced. This working surface would be made from wood, and cut into a "U" configuration. The top portion of the "U" would be cut out (open) so that a mechanic could extend his upper torso and head into the engine compartment of a vehicle. Two small plates, bolted to the underside of the platform, are used for height adjustment. These plates have a series of rounded "cut-outs", any one of which could rest on the top of the riser on the base. Two handles or poles are provided to allow the mechanic to easily guide the invention over the shop floor. Also provided, at the bottom of the "U", is a small footrest so that the mechanic does not slip downward in the inclined position. The entire top of the working surface, except for the footrest, is covered with foam padding and a leather outer covering.

Three steel pins, of varying lengths, are used to set the actual angle of inclination. These pins are easily slipped into recessed areas in both the working surface and the base. The first pin, which is also the shortest, is used when a mechanic desires to work in an automobile engine compartment. The second pin is used for working in the engine compartment of trucks. Finally, the third pin is used by a mechanic lying on his back while working on a car or truck on a lift.

The appealing features of the present invention are its ease of use, versatility, timesavings, optimum size, reasonable price, and its ability to allow mechanics to avoid the normal back and muscle strains associated with automotive repair work.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable workman's bed system for providing a support surface for a workman selectively positioned to facilitate his convenient positioning comprising, in combination:

a bed formed of a rigid material in a generally planar configuration having an upper surface and a lower surface and having parallel side edges with an upper edge and a lower edge, the upper edge having a recess in a generally rectilinear configuration extending downwardly from the upper edge for allowing a mechanic to access an engine of a vehicle therethrough and a foot rest extending upwardly from the lower edge, a central support plate with a plurality of arcuate recesses parallel with the upper and lower edges formed on the lower surface and an upper support plate with a cylindrical pin receiving recess formed therein on the lower surface of the bed which forms an acute angle with respect to the bed;

a base formed of a rigid material with a base plate having an upper surface and a lower surface, the base plate being formed with four castors extending downwardly from the corners of the lower surface of the base plate, a post extending upwardly from the base plate with a tube horizontally positioned thereon for being pivotally received by one of said plurality of arcuate recesses of the central support plate, the base plate also having a pair of linear vertically oriented hand poles coupled to and extending upwardly from the base plate to a height thereabove with vertically oriented handles thereon, the post having a cylindrical pin receiving recess therein facing towards the upper edge of the bed and forming an obtuse angle with respect to a horizontal; and a plurality of pins each having a unique predetermined length, each pin having an upper end positionable within the cylindrical pin receiving recess of the upper support plate and a lower end, wherein the pins are interchangeable within the cylindrical pin receiving recess of the post and the cylindrical pin receiving recess of the upper support plate to position the bed and the worker supported thereon at a predetermined angle.

2. An adjustable workman's bed system comprising, in combination:

a bed formed of a rigid material in a generally planar configuration having an upper surface and a lower surface and having parallel side edges with an upper edge and a lower edge, the upper edge having a recess extending downwardly from the upper edge for permitting a user lying on said upper surface to view an engine of a vehicle therethrough and a foot rest extending upwardly from the lower edge, a central support plate with an arcuate recess parallel with the upper and lower edges formed on the lower surface with an upper support plate with a pin receiving recess formed therein on the lower surface of the bed which forms an acute angle with respect to the bed;

a base formed of a rigid material with a base plate having an upper surface and a lower surface, a post extending upwardly from the base plate with a tube horizontally positioned thereon for being pivotally received bv said arcuate recess of the central support plate, the post having a pin receiving recess therein facing towards the upper edge of the bed and forming an obtuse angle with respect to a horizontal; and a plurality of pins each with a unique predetermined length and having an upper end removably positionable within the pin receiving recess of the upper support plate and a lower end removably positionable within the pin receiving recess of the post, wherein the pins are interchangeably positioned between the pin receiving recesses for positioning the bed at a predetermined angle.

3. The adjustable workman's bed system as claimed in claim 2 and further including a base formed of a rigid material with a base plate having an upper surface and a lower surface, the base plate being formed with four castors extending downwardly from the corners of the lower surface of the base plate.

4. The adjustable workman's bed system as claimed in claim 2 and further including a base plate having a pair of linear vertically oriented hand poles extending upwardly from the base plate to a height thereabove.

5. The adjustable workman's bed system of claim 2, wherein first, second and third pins are provided each having a length, the length of the first pin being sized to permit extension of the bed in a plane generally parallel to a horizontal plane, wherein the second pin is sized to permit extension of the bed in a plane at an angle between 30 degrees and 45 degrees from a horizontal plane, and wherein the third pin is sized to permit extension of the bed in a plane at an angle between 45 degrees and 60 degrees from a horizontal plane.

6. The adjustable workman's bed system of claim 2, wherein the bed has a length defined between the upper and lower edges, wherein the base has a length extending generally parallel to the length of the bed, wherein the length of the bed is greater than the length of the base.

7. The adjustable workman's bed system of claim 6, wherein the length of the bed is about twice the length of the base.

8. The adjustable workman's bed system of claim 3, wherein the base plate lies in a plane, wherein each of said hand poles has a longitudinal axis extending generally perpendicular to the plane of the base plate.

* * * * *